US008971560B2

(12) United States Patent
Lyons et al.

(10) Patent No.: US 8,971,560 B2
(45) Date of Patent: Mar. 3, 2015

(54) SOUND SYSTEM FOR PORTABLE DEVICES

(75) Inventors: Matthew Lyons, York, PA (US); Michael DiTullo, Carlsbad, CA (US); Quinn Slater Huffstetler, San Francisco, CA (US); Cormac Eubanks, San Francisco, CA (US); Steven Avi Friedman, San Francisco, CA (US)

(73) Assignee: DEI Headquarters, Inc., Vista, CA (US)

( * ) Notice: Subject to any disclaimer, the term of this patent is extended or adjusted under 35 U.S.C. 154(b) by 357 days.

(21) Appl. No.: 13/620,812

(22) Filed: Sep. 15, 2012

(65) Prior Publication Data

US 2014/0079267 A1 Mar. 20, 2014

(51) Int. Cl.
*H04R 1/02* (2006.01)

(52) U.S. Cl.
USPC ..... 381/334

(58) Field of Classification Search
None
See application file for complete search history.

(56) References Cited

U.S. PATENT DOCUMENTS

2011/0143583 A1* 6/2011 Zilmer et al. ..... 439/529
2011/0267773 A1* 11/2011 Macfarlane ..... 361/679.55
2012/0037771 A1* 2/2012 Kitchen ..... 248/223.41
2013/0142371 A1* 6/2013 Martin et al. ..... 381/333

FOREIGN PATENT DOCUMENTS

GB 2397707 A * 7/2004 ..... H02J 7/00

OTHER PUBLICATIONS

"TV Guardian—The Foul Language Filter", http://www.tvguardian.com/, web archive screen capture taken on Nov. 1, 2012.*
"Zooka Bluetooth Speaker for the iPad", The Fire Wire, Prepared and e-filed IDS according to instructions from K. Brillhart & R. Fish; updated database accordingly, screen capture Nov. 8, 2011.

* cited by examiner

*Primary Examiner* — Wayne Young
*Assistant Examiner* — Mark Fischer
(74) *Attorney, Agent, or Firm* — Fish & Tsang, LLP

(57) ABSTRACT

A speaker assembly comprises a portable device receiver and leg, allowing users to enjoy hands free viewing or listening experience. The sound system can be configured to provide an enhanced listening experience via at least one of a virtual surround system, a speaker driver, one or more speakers, adjustable control functions, and retained or increased acoustic power.

17 Claims, 5 Drawing Sheets

SOUND SYSTEM FOR PORTABLE DEVICES

FIELD OF THE INVENTION

The field of the invention is speakers, in particular speakers intended for use in with portable devices.

BACKGROUND

The following background discussion includes information that could be useful in understanding the present inventive subject matter. It is not an admission that any of the information provided herein is prior art or relevant to the presently claimed inventive subject matter, or that any publication specifically or implicitly referenced is prior art.

Portable devices are growing rapidly in popularity, allowing users to enjoy music, video, texts, images, and other forms of entertainment without being tethered to a home system. Because of the sometimes inferior sound quality offered by speaker assemblies in such devices, an increasing number of people are connecting their portable devices to external speaker assemblies, including for example, docking stations.

One example of a speaker assembly that operates with a tablet computer is the Zooka™ Bluetooth Speaker shown at firewireblog.com/2012/02/16/zooka-bluetooth-speaker-for-the-ipad/. This device is an attachable Bluetooth speaker that couples with the top of a tablet computer. The Zooka comes with a rod that can be partially stored inside a cavity of the speaker, and screwed into a hole in the speaker housing. The rod, however, can easily be lost, and requires assembly for use as a stand. Moreover, the Zooka, while providing a somewhat improved audio experience, apparently fails to provide various speaker drivers (e.g., front-firing drivers, down-firing drivers, etc.) or a virtual surround system.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Thus, there is still a need for a speaker assembly configured to provide an improved audio and video experience.

SUMMARY OF THE INVENTION

The inventive subject matter provides apparatus, systems and devices that provide a speaker assembly configured for use with a portable device, including for example, a tablet computer, a laptop, a mobile phone, or an electronic book reader.

In some aspects of the inventive subject matter, a speaker assembly comprises a leg and a receiver (e.g., slot, clamp, etc.) configured to receive an edge of a portable device. The leg and receiver are coupled to a housing having (1) a speaker, (2) sound perforations along a portion of the surface, and (3) a septum that separates a receiver biasing mechanism from an acoustic chamber. In some preferred embodiments, the mechanism chamber (i.e., the chamber housing the receiver biasing mechanism) has a smaller width than the acoustic chamber.

It is contemplated that the housing, leg, and receiver could be of any suitable size and shape. In some aspects of the inventive subject matter, a housing is sized and configured to accommodate some or all of a battery, a circuit board (e.g., a printed circuit board), a speaker, or a subwoofer, woofer, bass shaker, amplifier, tweeter, or any other suitable speaker driver.

It is contemplated that a receiver can be coupled to a receiver biasing mechanism (e.g., a button and spring biasing mechanism, a snap and release mechanism, or any other suitable mechanism) such that the receiver is in a first position or a second position depending on the position of the mechanism relative to the rest of the housing. For example, a clamp could loosen when a button is flush with the housing, and tighten when a button is extended away from the housing.

The portable device generally couples to the speaker assembly in such a way that the speaker acts as a sound emitter for the portable device (i.e., the sound that would normally be emitted from the portable device would instead be emitted from the speaker assembly). This coupling can be via one or more wired or wireless connections. All suitable connectors are contemplated, including for example, a multi-pin dock connector and an auxiliary cable.

Various objects, features, aspects and advantages of the inventive subject matter will become more apparent from the following detailed description of preferred embodiments, along with the accompanying drawing figures in which like numerals represent like components.

DETAILED DESCRIPTION

The inventive subject matter provides apparatus, systems and devices that provide a speaker assembly configured for use with a portable device.

One should appreciate that the disclosed techniques provide many advantageous technical effects including providing a single speaker system that allows a user to enjoy their portable devices in a wide variety of domestic and outdoor settings without the user having to manually hold onto the portable devices at what might be an uncomfortable angle. The sound system also allows users to enjoy media via a portable device with improved sound quality or volume.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
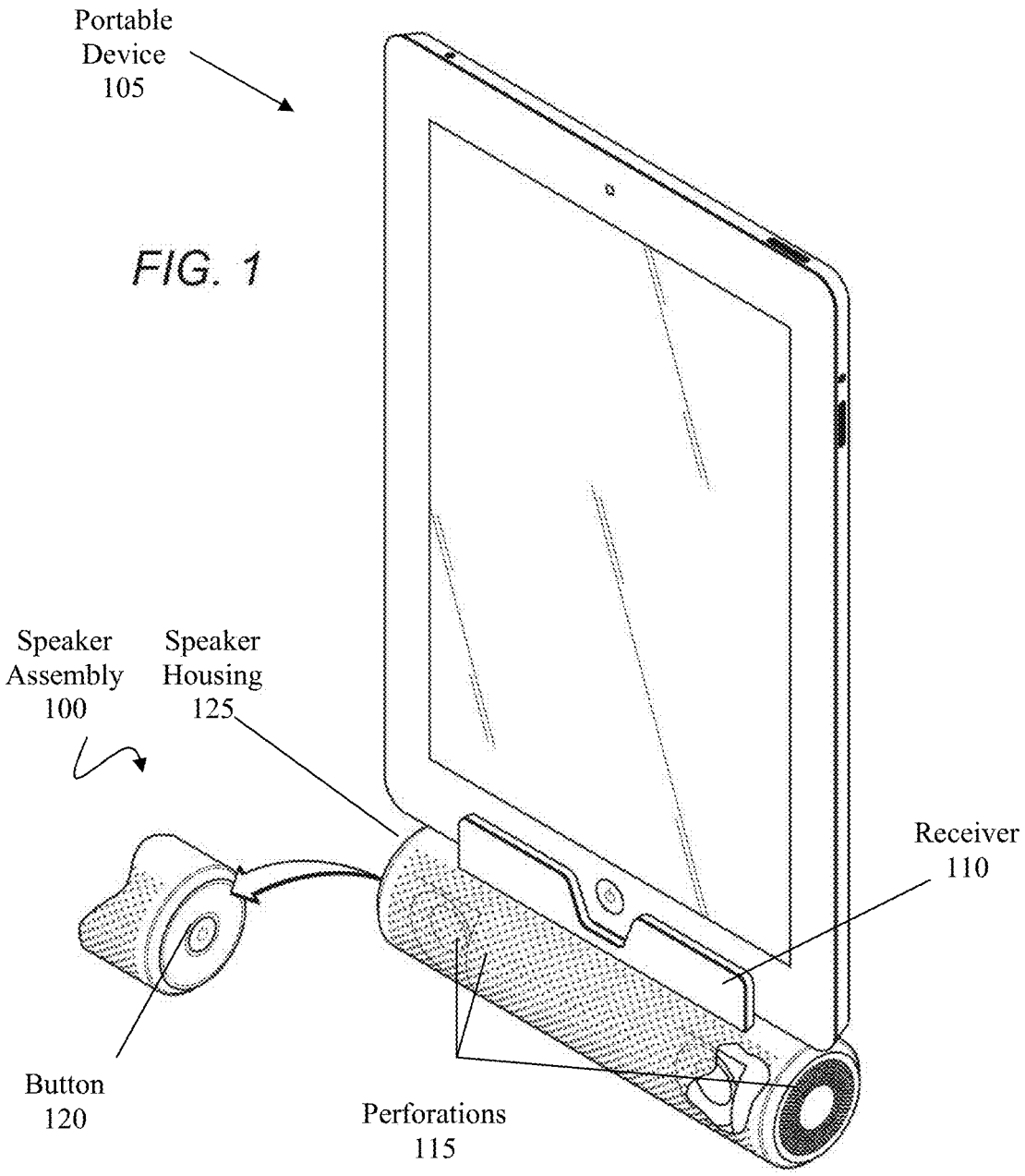
FIG. 1 is a perspective view of a speaker assembly of the inventive subject matter coupled with a tablet computer.

FIG. 1 shows a speaker assembly of the inventive subject matter holding a tablet computer. Speaker assembly 100 comprises a receiver 110, speaker housing 125, a plurality of perforations 115, and a button 120 (e.g., a power button, volume button, speaker mode button, etc.).

It is contemplated that the receiver (e.g., a clamp, etc.) could be pivotable, rotatable, or otherwise movable along the outside perimeter of the housing, to allow a user to modify an angle of the portable device's screen relative to the user without moving the speaker assembly.

Contemplated speaker housings can comprise any suitable size and shape, including for example, a cylinder, a cube, a rectangular cube, an egg, or a pyramid. Each component of the speaker assembly could be made of one or more materials, including for example, plastic, silicon, metal, wood, rubber, aluminum-coated polypropylene, aramid, cast aluminum, CMMD, a ceramic, foam, glass-imide, graphite-injected polypropylene, or any other suitable material.

In some embodiments of the inventive subject matter, the speaker assembly comprises a virtual surround system (e.g., ones that use head-related transfer function (HRTF) knowledge, reflections, diffuse sources, etc.) that creates the perception that there are additional sources of sound than are actually present.

Another component that could be included in a speaker assembly is a device (e.g., 206) that selectively mutes, edits or otherwise alters sounds, words or phrases that a user finds objectionable, e.g., profanities. One example of a device that selectively mutes some objectionable words in movies or television shows can be seen at www.tvguardian.com/.

Figures 2, 3:
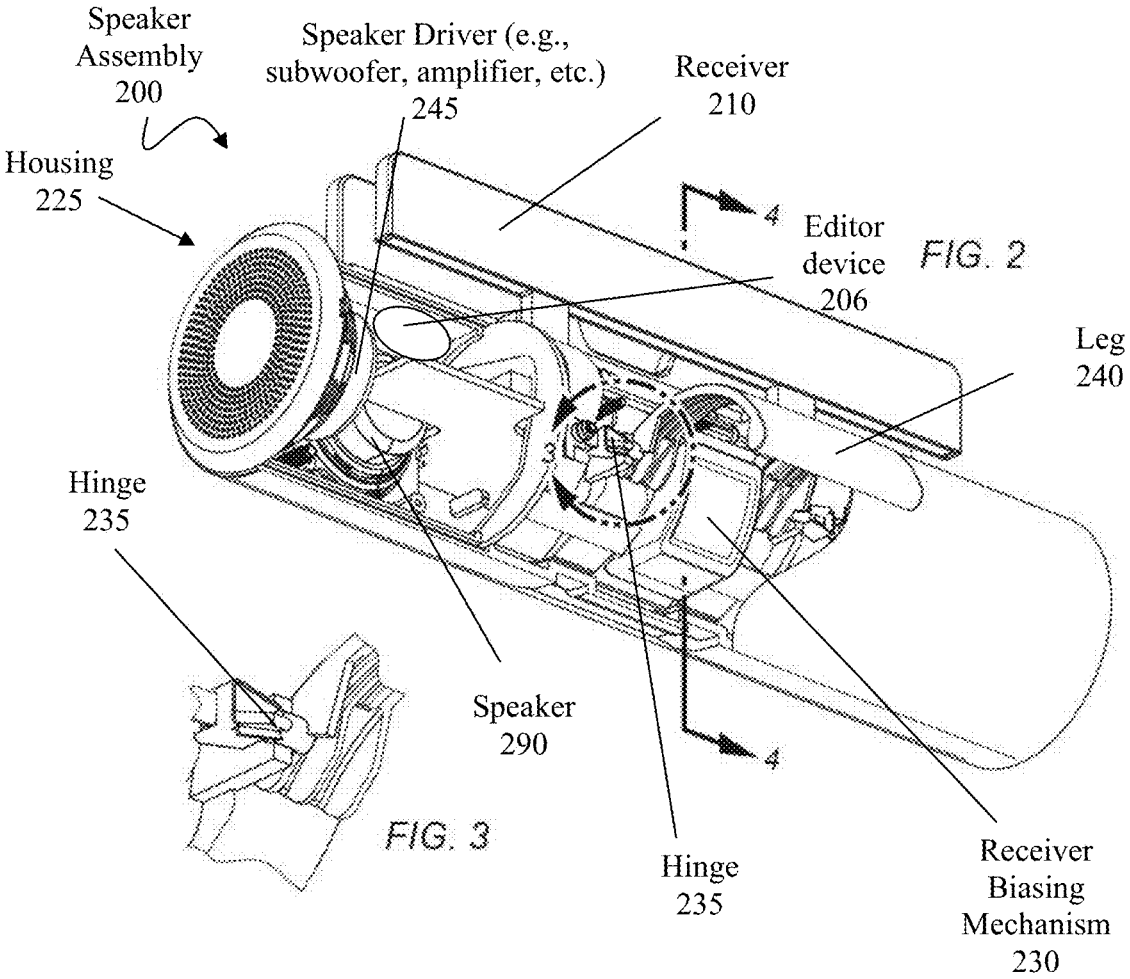
FIG. 2 is a rear perspective view of a speaker assembly with a portion of the housing removed exposing the interior.
FIG. 3 is a detail view of a coupling mechanism of a leg.

FIG. 2 shows a speaker assembly with a portion of the housing removed. Speaker assembly 200 comprises a receiver 210, a housing 225 having a speaker driver 245, two speakers (one shown at 290), a receiver biasing mechanism (e.g., button with spring), and a leg 240 coupled to the housing via a hinge 235. A close-up view of the hinge 235 is shown in FIG. 3.

It is contemplated that a hinge could be of any suitable size and type. Hinge 235, for example, comprises a spring mechanism that is configured in such a way that biases leg 240 in completely retracted and completely extended positions.

Figures 3A, 3B, 3C:
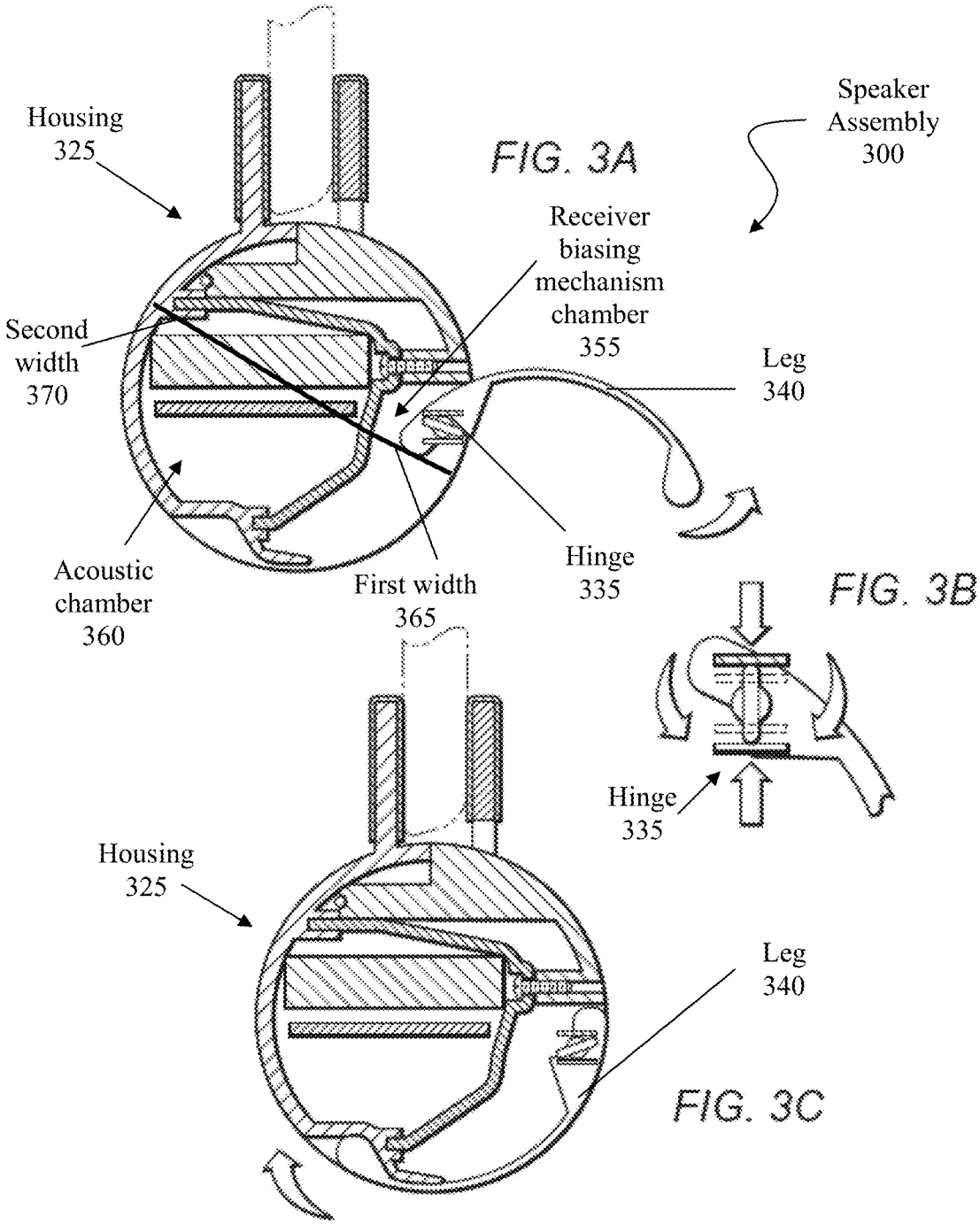
FIG. 3A is a cross-section view of a speaker assembly with an extended leg.
FIG. 3B is a cross section detail view of a coupling mechanism of a leg showing a bias to a closed position.
FIG. 3C is a cross section view of the speaker assembly of FIG. 3A with a closed leg.

FIGS. 3A-3C show cross-sectional views of a speaker assembly or portion thereof. In FIG. 3A, leg 340 is movably (e.g., pivotably, rotatably, etc.) attached to housing 325 and extended in order to keep cylindrical housing 325 from rolling. Septum 350 is disposed within housing 325 and creates two separate chambers. Here, a receiving biasing mechanism (not shown) chamber 355 and an acoustic chamber 360 are created by septum 350.

Receiver biasing mechanism chamber 335 extends across a first width 365 of the central width of housing 325, and acoustic chamber 360 extends across a second width 370 of the central width of housing 325. It is contemplated that a septum could divide a housing or a sub-housing (enclosed portion within a housing) into two chambers. In some preferred embodiments, and in FIGS. 3A and 3C, the first width 365 is smaller than second width 370. However, a septum could be disposed at any position within a housing, and create chambers of any suitable shapes and sizes.

FIG. 3B shows hinge 335 having a spring biasing mechanism. In FIG. 3C, leg 340 is retracted, and positioned flush with a surface of housing 325.

Figure 4:
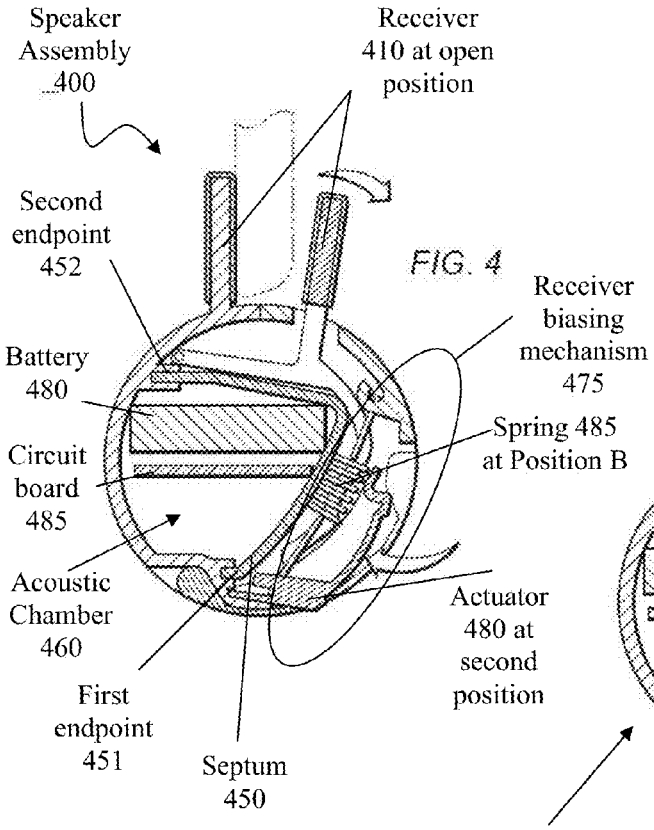
FIG. 4 is a cross section view of a speaker assembly showing the receiver biasing mechanism actuated.
Figure 5:
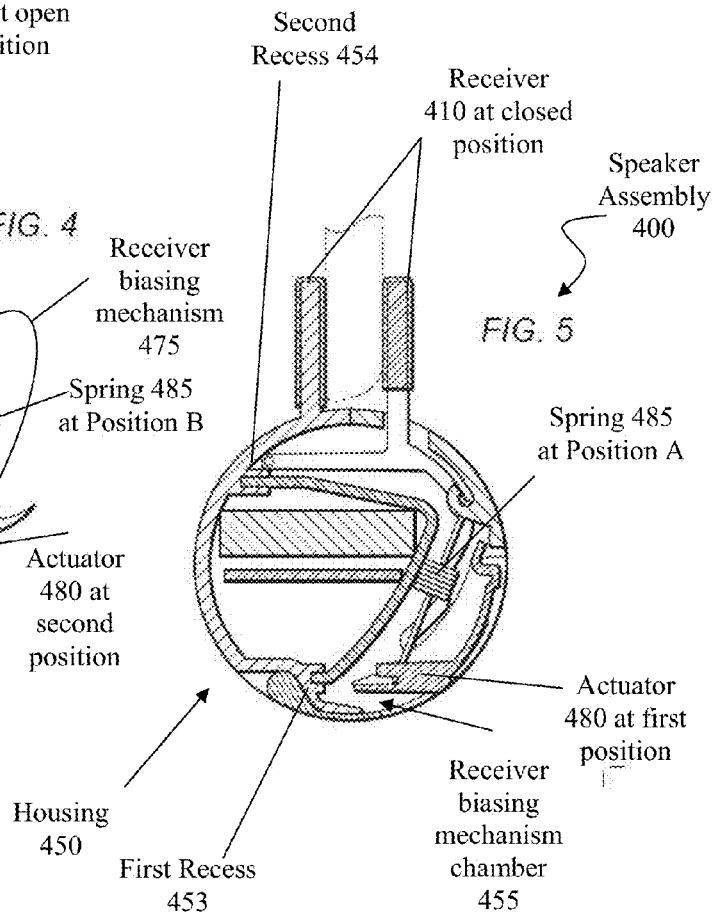
FIG. 5 is a cross section view of the speaker assembly of FIG. 4 showing the receiver biasing mechanism released.

FIGS. 4 and 5 show cross-sectional views of a speaker assembly at a mid-section of the receiver biasing mechanism. In FIG. 4, receiver biasing mechanism 475 comprises an actuator (e.g., a button, a slider, etc.) 480 and spring 485, configured to operate in conjunction with receiver 410. Where actuator 480 is in a first position (e.g., FIG. 5), a spring 485 coupled to receiver 410 is in position A (e.g., compressed) and biases the receiver at a closed position. When the button is actuated and moved to a second position (e.g., pressed towards the housing, slid along a circumference of a housing, lifted away from the housing, etc.) as in FIG. 4, the spring 485 is in position B (e.g., stretched) and receiver 410 is moved to an open position.

Various types of receiver biasing mechanisms are contemplated, including for example, a spring coupled with a button, slider, or other actuator, or any other mechanism or device configured to bias a first portion of a receiver to a first position relative to a second portion of the receiver.

Septum 450 comprises first and second endpoints or protrusions, 451 and 452, configured to fit into recesses 453 and 454 or housing 425. It is contemplated that septum 450 remains in a first position, such that acoustic chamber 460 is unaffected by actuation of the receiver biasing mechanism 475.

In some preferred embodiments, the mechanism chamber 455 extends along a first outer edge of the interior of a housing, while acoustic chamber 460 extends along a second outer edge of the interior of a housing. First outer edge could be shorter, equal to, or longer than the second outer edge.

Acoustic chamber 460 could comprise one or more components of speaker assembly 400, including for example, a battery 480, a circuit board 485 (e.g., a printed circuit board), or any other housing component. Some of the acoustic chamber's volume should be free of mechanical and electrical components such that the natural acoustic qualities of the assembly are retained. In some preferred embodiments, at least 20%, 40%, 50%, or even 75% or more of the acoustic chamber's volume is free of mechanical and electrical components. It is also contemplated that the acoustic chamber could be substantially or completely enclosed.

In preferred embodiments, it is contemplated that a user can selectively manipulate different frequencies emitting from the speaker assembly. For example, equalization (EQ) and head-related transfer function (HRTF) can be accomplished by digital signal processing or analog means, either jointly or independently.

Figure 6:
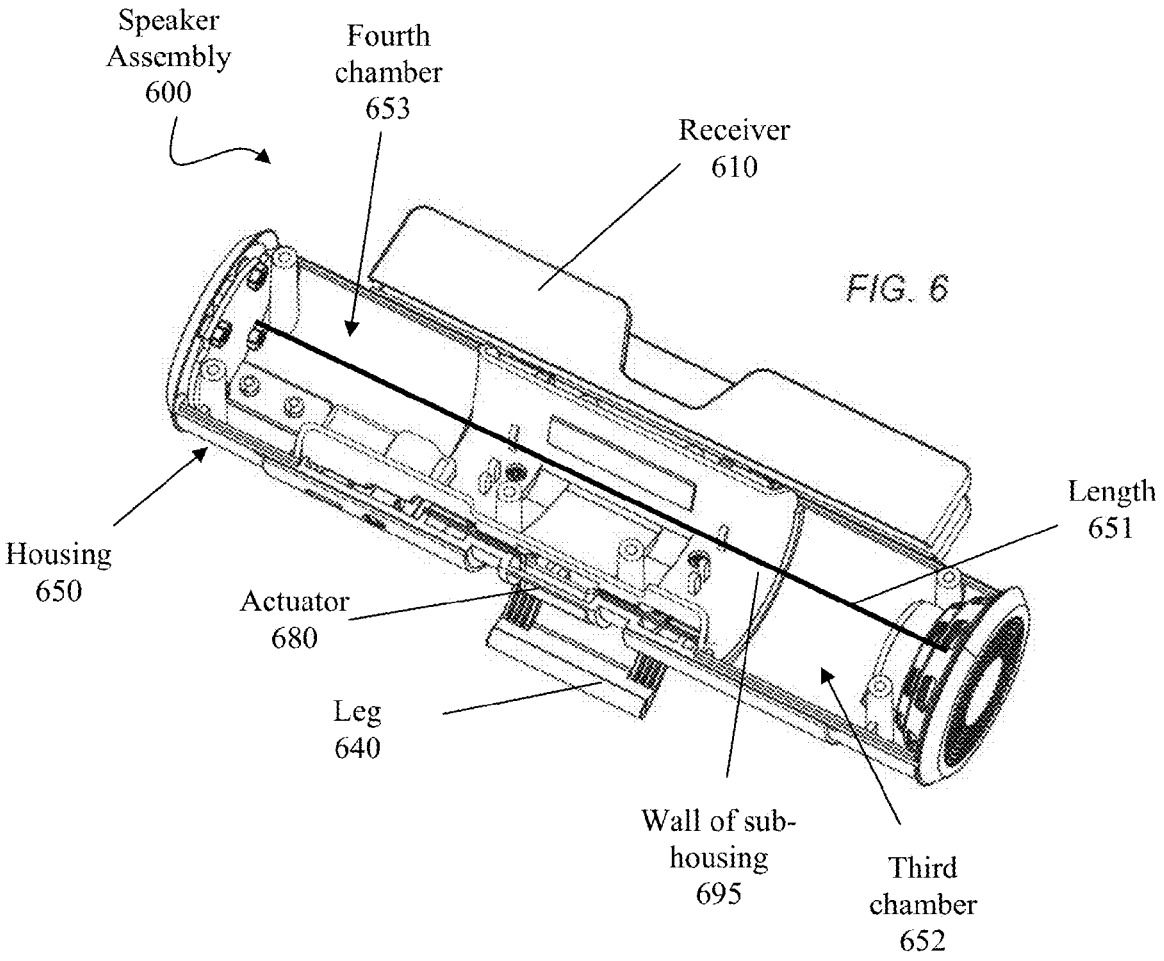
FIG. 6 is a perspective view of a speaker assembly with a portion of the housing removed.

FIG. 6 shows a speaker assembly with a portion of the housing removed. Speaker assembly 600 comprises a receiver 610, a leg 640, a housing 650, and actuator 680. Housing 650 houses a sub-housing (wall of sub-housing shown at 495) configured to enclose a septum, an acoustic chamber and a mechanism chamber. As shown in FIG. 6, the sub-housing extends across a portion of a length 651 of housing 650, leaving a third chamber 652 and a fourth chamber 653 to house a first and second speaker, among other components.

Contemplated speaker assemblies could comprise additional components that allow a user to interact with the assembly. As an example, a physical button, a touch-screen button or a slider on a display (e.g., LED screen or other screen coupled with the housing), or other control could allow a user to adjust a volume or a setting of the speaker assembly. Thus, a user could press a button to increase a volume of one side of the speaker and press another button to decrease a volume of another side of the speaker. The user could also adjust a sound immersion parameter or intensity. Moreover, it is contemplated that a user could control a function of the portable device via the speaker assembly (e.g., pause, play, stop, etc.).

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps could be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A speaker assembly for a portable computer, comprising:

a speaker housing that houses a first speaker;

a septum disposed within the housing between first and second chambers;

a receiver having an opening, the opening configured to receive an edge of the portable computer;

a receiver biasing mechanism comprising a button coupled to a spring, disposed entirely within the first chamber, and configured to widen the opening;

a leg pivotally attached to the speaker housing, and disposed to provide support to the speaker housing.

2. The speaker assembly of claim 1, wherein the first chamber has a smaller volume than the second chamber.

3. The speaker assembly of claim 1, wherein the receiver comprises a first clamp arm and a second clamp arm on opposing sides of a slot.

4. The speaker assembly of claim 1, further comprising a plurality of perforations along at least 20% of a side of the housing.

5. The speaker assembly of claim 1, further comprising a second speaker.

6. The speaker assembly of claim 5, further comprising a subwoofer disposed on a side portion of the housing.

7. The speaker assembly of claim 1, further comprising at least one of a subwoofer, an amp, and a woofer disposed in the housing.

8. The speaker assembly of claim 1, wherein the speaker assembly has no pin connection to the portable computer.

9. The speaker assembly of claim 8, wherein the speaker assembly has an auxiliary connection to the portable computer.

10. The speaker assembly of claim 1, wherein the receiver has a length of between 3 and 8 inches inclusive.

11. The speaker assembly of claim 10, wherein the receiver has a width of between 1 and 3 centimeters inclusive in a closed position.

12. The speaker assembly of claim 1, wherein the receiver has a width of between 1 and 4 centimeters inclusive.

13. The speaker assembly of claim 1, wherein the housing has an end to end length, and the sound perforations are disposed along at least 70% of the length of the housing.

14. The speaker assembly of claim 1, wherein the housing has an external surface area, and sound perforations are disposed along at least 70% of the external surface area.

15. The speaker assembly of claim 1, further comprising a display screen at least partially disposed within the housing.

16. The speaker assembly of claim 1, further comprising an electronic editor device configured to silence a selected sound.

17. The speaker assembly of claim 1, wherein the housing comprises a cylinder.

* * * * *